United States Patent [19]

Riddel

[11] 4,383,411

[45] May 17, 1983

[54] DIESEL EXHAUST CLEANER WITH BURNER VORTEX CHAMBER

[75] Inventor: John W. Riddel, Fenton, Mich.

[73] Assignee: General Motors Corporation, Detroit, Mich.

[21] Appl. No.: 291,310

[22] Filed: Aug. 10, 1981

[51] Int. Cl.[3] ..... F01N 3/02

[52] U.S. Cl. ..... 60/303; 60/311

[58] Field of Search ..... 60/303, 286, 311, 288

[56] References Cited

U.S. PATENT DOCUMENTS

| | | | |
|---|---|---|---|
| 3,804,597 | 4/1974 | Inoue | 60/286 |
| 4,054,418 | 10/1977 | Miller | 60/303 |
| 4,217,757 | 8/1980 | Crone | 60/303 |
| 4,281,512 | 8/1981 | Mills | 55/523 |
| 4,335,574 | 6/1982 | Sato | 60/311 |
| 4,345,431 | 8/1982 | Suzuki | 60/303 |

*Primary Examiner*—Douglas Hart

*Attorney, Agent, or Firm*—Arthur N. Krein

[57] ABSTRACT

A diesel engine exhaust cleaner and burner system includes at least one exhaust cleaner member with a filter positioned therein to effect removal of particulates from a stream of exhaust gas delivered thereto via an inlet manifold. A fuel burner supplied with fuel by a fuel nozzle is operatively associated with the inlet manifold to supply the necessary heat to effect incineration of particulates collected on the filter. A cyclone duct providing a vortex chamber therein is operatively positioned downstream of the fuel nozzle and is supplied with sufficient air so as to effect both the complete combustion of the fuel and the controlled incineration of the particulates by increasing the residence time of the fuel in the reaction region within the vortex chamber and also effecting a more uniform distribution of the heat of combustion across the inlet face of the filter for the uniform heating of the particulates thereon to their combustion temperature.

3 Claims, 3 Drawing Figures

DIESEL EXHAUST CLEANER WITH BURNER VORTEX CHAMBER

BACKGROUND OF THE INVENTION

This invention relates to diesel engine exhaust treatment systems, and, in particular, to an exhaust cleaner and burner system for collecting and then incinerating particulates discharged in the exhaust gases from a diesel engine.

DESCRIPTION OF THE PRIOR ART

It is known in the art to provide a diesel engine with an exhaust treatment system that includes one or more particulate traps or filters that are operative to filter out and collect particulates from the exhaust gas stream discharged from the engine. Such particulates consists largely of carbon particles that tend to plug the filter, thus restricting exhaust gas flow therethrough. Accordingly, after continued use of such a system for a period of time dependent on engine operation, it becomes desirable to effect regeneration of the particulate filter.

Restoration or regeneration of such a particulate filter has been accomplished by the use of a suitable auxiliary burner device. For example, an air-fuel nozzle and an ignition device can be used and operated, when desired, to heat the particulate filter to the combustion temperature of the collected particulates so as to burn them off the filter surfaces and, accordingly, to thus reopen the flow paths therethrough to again permit normal flow of the exhaust gases through that filter.

However, upon ignition and continued oxidization of the accumulated particulates on the filter during the regeneration operation, a large amount of energy is released which generates a rapid temperature rise within the filter. If this is not evenly distributed throughout the body of the filter, thermal gradients will result in both radial and axial directions which, if excessive, can cause mechanical failure of the filter structure. Normally such radial thermal gradients occur in part due to the fact that, if a conventional air/fuel burner assembly is used to provide the necessary heat for combustion of the particulates, the particulates generally ignite at a localized central area of the filter and then fans radially toward the outer peripheral areas of the filter.

Accordingly, in order to substantially reduce these thermal gradients in at least the radial direction, it would be desirable to heat substantially the entire inlet face of the filter uniformly to the ignition temperature of the particulates so that ignition thereof will occur across the entire radial area of the filter.

SUMMARY OF THE INVENTION

Accordingly, a primary object of the invention is to provide an improved exhaust cleaner and burner system for use with a diesel engine that advantageously utilizes a structure whereby the air used to effect the incineration of partculates on a filter is introduced so as to create a vortex downstream of a fuel burner so as to effect complete combustion of the fuel supplied by the burner and also to more uniformly distribute the heat of this combustion across the inlet face of the filter.

Another object of the invention is to provide an improved exhaust cleaner system for use with a diesel engine having a vortex chamber, supplied with air, positioned between a fuel burner means and the inlet face of an associated filter in the system with these last two elements positioned coaxial with the vortex chamber.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
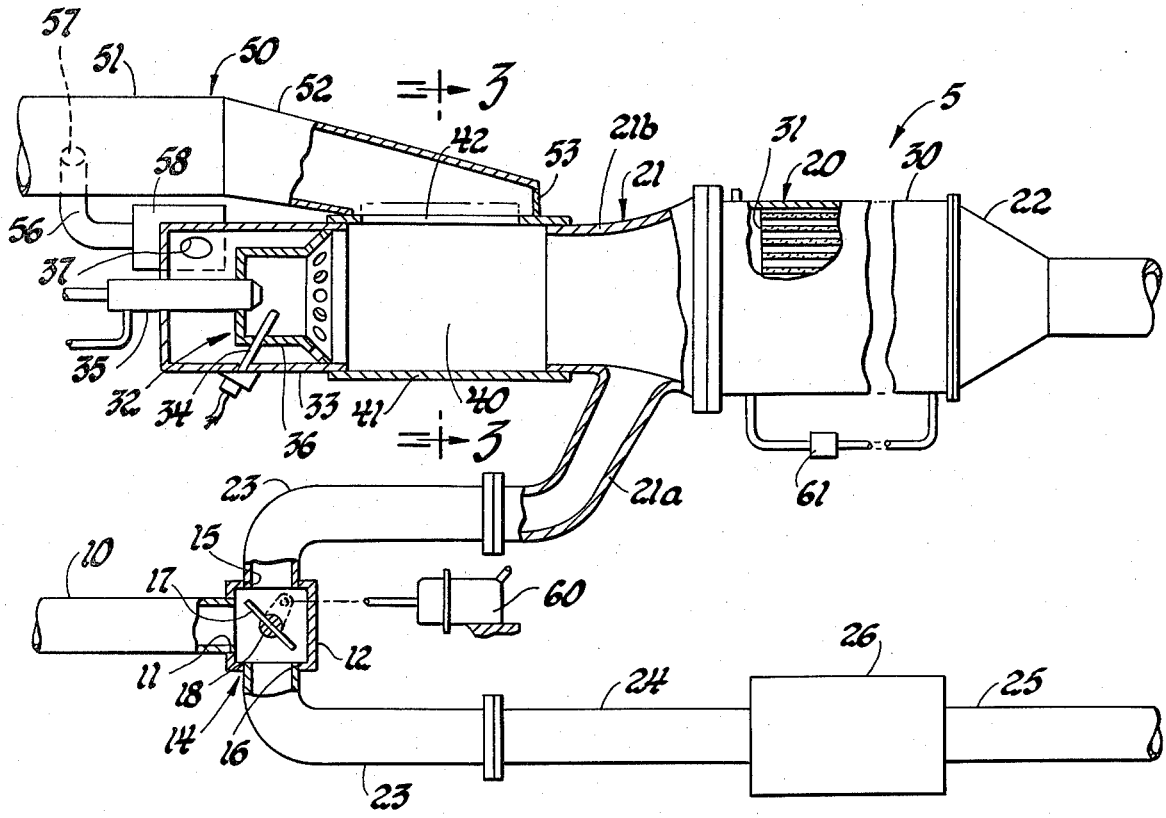
FIG. 1 is a schematic view of a preferred embodiment of a diesel exhaust cleaner system with burner vortex chamber, in accordance with the invention, for use with a diesel engine, with parts broken away to show various details of the system.

Referring now to the drawings, there is illustrated in FIG. 1 a single path with exhaust bypass embodiment of an exhaust cleaner system, generally designated 5, with a burner vortex chamber, in accordance with the invention, that is to be used with a diesel engine, not shown.

The exhaust cleaner system 5 includes an exhaust passage 10 that is adapted to be suitably connected at one end to the diesel engine so as to receive the flow of exhaust gas discharged therefrom. The opposite end of this exhaust passage 10 is connected to the inlet 11 in the valve housing 12 of a flow control valve 14. Valve housing 12 is also provided with first and second outlets 15 and 16, respectively, with the flow from inlet 11 to either outlet 15 or outlet 16 controlled by a valve member 17 fixed to a shaft 18 that is suitably journaled for pivotable movement in the valve housing 12.

An exhaust cleaner member 20, having an intake manifold section 21 and a discharge section 22, has a side branch 21*a* of its intake section 21 connected via a conduit 23 for flow communication with the outlet 15 while an exhaust bypass duct 24 has one end thereof, the left hand end with reference to FIG. 1, connected via a second conduit 23 for flow communication with the outlet 16 of valve 14. The bypass duct 24 is adapted to discharge exhaust gases directly to the atmosphere or, if desired, it can be connected to a conventional exhaust pipe 25 and muffler 26. In a similar manner, the discharge section 22 of the exhaust cleaner member 20 is adapted to discharge fluid directly to the atmosphere or, if desired, a conventional exhaust pipe and muffler can be connected to the free end thereof.

Intermediate the intake manifold and discharge sections 21 and 22, respectively, the cleaner member 20 is provided with a housing portion 30. This housing portion 30 is of suitable configuration whereby to support a particulate trap or filter 31 therein for flow communication with the associate intake manifold and discharge portions at opposite ends thereof. Preferably, suitable thermal insulation, not shown, is used to reduce radial heat loss from the housing portion 30 and, in particular from the filter 31.

The particulate filter 31 may be of any material and construction suitable for use in a diesel engine exhaust system to collect particulates and other combustibles present in the stream of exhaust gas discharged from the engine and which may subsequently be heated to the combustion temperature of the particulates whereby to permit incineration of these particulates so that the filter may be regenerated. Suitable materials may include, for example, ceramic beads or monolith ceramic structures similar to those currently used as catalyst support means in exhaust catalytic converters presently used in many gasoline fueled automobile engines. Alternately, metal wire mesh or multiple screen elements may also provide suitable filter element materials for this purpose.

In the emodiment illustrated, the particulate filter 31 is a monolithic ceramic structure of honeycomb configuration so as to provide parallel channels running the length thereof. Alternate cell channel openings on the monolith inlet face are blocked and, at the opposite end the alternate channel openings are blocked in a similar manner but displaced by one cell. This arrangement the exhaust gas cannot flow directly through a given channel but is forced to flow through the separating porous walls into an adjacent channel. The exhaust gas is thus filtered as it flows through the porous walls between adjacent channels.

Additional heat needed to raise the temperature of the particulates trapped on the filter 31 to their combustion temperature is supplied by a suitable heater means. In the embodiment shown the heater means inlcudes an air-fuel mixing and atomizing burner assembly 32 operatively positioned in a burner housing 33 that is connected to the axial extending intake passage extension 21*b* of the intake manifold section 21 of the cleaner member 20 in a manner to be described. This burner assembly 32 is capable of supplying an atomized combustible air-fuel mixture to the interior of the burner housing 33 and thus to the intake manifold section 21. A suitable electric igniter 34, such as a spark plug, as shown, or a glow plug, is also operatively mounted to the burner housing 33 for igniting the air-fuel mixture supplied by the burner assembly 32.

The atomizing burner assembly 32, in the embodiment shown, includes a conventional fuel nozzle 35, which may be of the air atomizing type as shown, and which is positioned so that its discharge spray type end projects into an apertured burner hood 36. The burner hood 36 is suitably supported concentrically within the burner housing 33.

Figure 2:
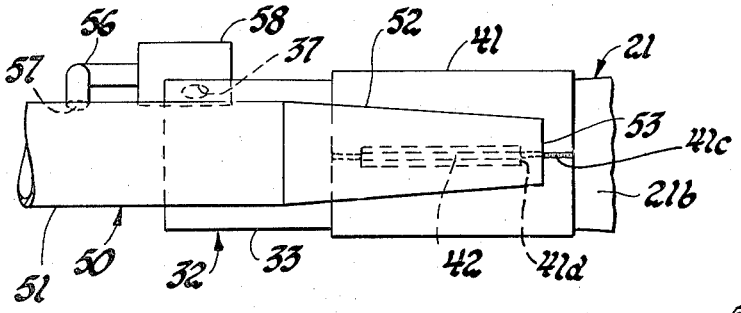
FIG. 2 is a top view of the burner and vortex chamber section, per se, of the exhaust cleaner system of FIG. 1; and, FIG. 3 is a sectional view of the vortex chamber and the associated air inlet conduit, per se, taken along line 3—3 of FIG. 1.

If desired and as shown in FIGS. 1 and 2, a small amount of additional air may be supplied to the atomizing burner assembly 32 by means of an inlet port 37 in the burner housing 33 from a suitable auxiliary source of air such as an air pump, not shown, which may be engine driven or which may be in the form of an electrical air pump.

Now in accordance with a feature of the invention, the necessary oxygen required to effect the controlled incineration of the accumulated particulates on the filter 31 is delivered from a suitable source of air into a vortex chamber 40 within a cyclone duct 41 that is located upstream of the filter 31 and coaxial therewith in a manner to be described hereinafter.

In the embodiment illustrated, the cyclone duct 41 is formed as a separate duct that is adapted to be suitably fixed between the atomizing burner assembly 32 and the inlet 21*b* of the intake manifold section 21, as by having the discharge end of the burner housing 33 telescopically received within one end thereof and having the inlet 21*b* of the intake manifold section 21 telescopically received in the opposite end, with these parts then being secured as by welding.

Figure 3:
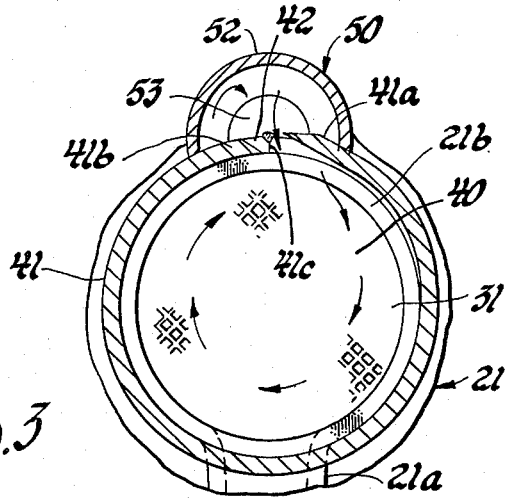

The cyclone duct 41 is in the form of a substantially cylindrical duct 41 having a longitudinal air entrance slot 42 extending through the outer peripheral wall thereof. As best seen in FIG. 3, the longitudinal sides forming the width of the air entrance slot 42, in effect, define a convolute shaped passage arranged so as to direct incoming fluid flow substantially tangential to the inner peripheral wall surface of the duct 41. For this purpose, the upper right side wall portion 41*a*of the duct 41, with reference to the embodiment shown in FIG. 3, is of convolute shape so that its free end which defines the right hand side of the air entrance slot extends above the wall portion 41*b*defining the left hand side of the air entrance slot, with the left side, per se, of this slot being preferably formed so as to be parallel to the other portion of the opening to assist in directing the fluid flow in a clockwise direction with reference to this Figure.

In the particular construction shown, the cyclone duct 41 was formed from a suitably shaped and slitted piece of sheet metal which was rolled around circular discs temporarily located at opposite ends thereof. At the opposite ends, the abutting edges 41*c* of the sheet metal were then welded together to form the circular end portions of the duct. The spaced apart parallel slits 41*d* at opposite ends of the intended slot opening permit the wall portion 41*a*to extend tangential to the base inner circle of the duct so as to provide the convolute portion of the duct, as best seen in FIG. 3. By making the slits of predetermined length, the width of the air entrance slot can be predetermined accordingly.

Air is supplied to the vortex chamber 40, from a source of air, such as an engine driven or electriical air pump, not shown, via an auxiliary air duct 50. In the embodiment illustrated, the air duct 50 includes a straight circular duct portion 51 that is adapted at one end thereof, the left hand end with reference to FIGS. 1 and 2, to be connected to the source of air, while at its other end it is fixed to a part truncated cone shaped, air entrance duct portion 52. The duct portion 52 is cut or formed with a longitudinal extending opening on one side thereof, with the edges of the cut portion secured, as by welding, to the outer peripheral surface of the cyclone duct 41 on opposite sides of the air entrance slot 42, as best seen in FIG. 3. An end cap 53 is secured, as by welding, to the free end of the duct portion 52.

In the construction shown, the air entrance duct portion 52 was made for example, by cutting a wedge shaped piece off one end of a tube of the same diameter as that of the duct portion 51. The cut portion of the tube was then reformed so that the cut end portion thereof was in the shape of a truncated cone with the small end thereof having a diameter of approximately one/half that of the original tube diameter. The free ends of this cone shaped portion of the tube were then welded over the air entrance slot 42 on the cyclone duct 41 and the small end thereof was then plugged by welding the end cap 53 thereto.

In the embodiment shown, the auxiliary air duct 50 is also used to supply air to the atomizing burner assembly 32. For this purpose, a branch conduit 56 has one end thereof fixed in flow communication, via an opening 57, with the duct portion 51, while the opposite end of the branch conduit 56 is located for flow communication with a plenum box 58 suitably fixed, as by welding, to the burner housing 33 so as to overlie the inlet port 37 therein.

Referring again to the exhaust cleaner system 5 the valve member 17 of the control valve 14 thereof is operated by a suitable actuator, such as a conventional two-position actuator 60. The vacuum fitting of this actuator 60 is adapted to be selectively connected to a suitable source of vacuum or to the atmosphere, as controlled by a solenoid valve, not shown. The solenoid valve, not shown, would be connected to a source of electric power, as controlled by means of, for example, an electronic control unit, not shown, in a manner well known in the art.

In addition to the operational control of the vacuum actuator 60, the electronic control unit can also be used to control the operation of both the fuel nozzle 35 and of the electric igniter 34. For this purpose, the electronic control unit would, in a conventional manner, receive input signals of various engines operating conditions and, in addition, would also preferably receive a suitable signal indicating, for example, the pressure differential existing across the particulate filter 31 during engine operation. This pressure differential is sensed by a suitable pressure differential gauge 61 operatively connected for communication with both the inlet and outlet sides of the particulate filter 31 whereby to measure the pressure drop across this filter.

The electronic control unit can also be used to control the operation of a suitable air control valve, not shown, used to control the delivery of air from the air source, such as an engine driven air pump not shown, to the auxiliary air duct 50. Preferably the control is such that air is supplied to the auxiliary air duct 50 only during the regeneration of the filter 31.

In operation, exhaust gases from the associate diesel engine, not shown, discharged into the system 5 by means of the exhaust passage 10. During normal operation, the valve member 17 would be rotated 90° counter-clockwise from the position shown in FIG. 1 so that the exhaust gas entering the control valve 14 would be directed to flow through the exhaust cleaner member 20 so as to be cleaned by the particulate filter 31 therein. The clean exhaust gas would then be discharged to the atmosphere via the discharge section 22.

During the trap regeneration cycle, which cycle would be initiated after excessive back pressure build up, the valve member 17 will be rotated to the position shown in FIG. 1. As thus positioned, this valve member will then divert the exhaust gases to flow into the bypass duct 24 for discharge to the atmosphere, the valve member 17 then blocking direct flow of exhaust gas to the exhaust cleaner member 20.

It should now be apparent that when the valve member 17 is in the position shown in FIG. 1, the particulate filter 31 is then, in effect, an inactive filter. Assuming that this inactive filter 31 contains carbon and other particulates previously collected, these particulates are then removed from this filter by incineration. The necessary heat to effect this incineration is obtained by means of the burner assembly 32 which supplies a combustible air fuel mixture which is ignited by the electic igniter 34. The operation of both of these last two elements being controlled, as required, by the electronic control unit, not shown.

After a time interval sufficient to effect complete incineration of the particulates on the filter 31, as determined for example by a preselected decrease in the pressure drop across the filter, the operation of the heating means is discontinued. Thereafter the valve member 17 is re-positioned so that the exhaust gas is again directed to flow through the exhaust cleaner member 20.

In the above operation of the system, it is known that the total particulate load is an important parameter for controlling filter trap regeneration frequencies and temperature during regeneration. It is also known that with a chemically correct air/carbon mass ratio of 11.4:1, the reaction during oxidation of the particulates can produce an adiabatic combustion temperature rise of approximately 4700° F. It will thus be apparent to those skilled in the art that a relatively lean air/carbon ratio is preferably used during incineration of the particulates so as to reduce the reaction temperature within the filter 31 to a predetermined maximum temperature level, as desired, compatible with the material from which the filter has been fabricated.

Accordingly, the total amount of air delivered to the system during the incineration cycle should be such so as to effect the complete combustion of the fuel supplied by the fuel nozzle 35 into the burner assembly 32 and, to also effect the controlled incineration, as desired, of the particulates on the filter 31.

In the system configuration shown in FIG. 1, it will be apparent that the air and fuel introduced into the atomizing burner assembly 32 will have substantially an axial flow component as it emerges from this burner assembly. However, the air introduced into the vortex chamber 40, in the manner described hereinabove, will have substantially an angular flow component. Accordingly a significant part of the total air flow supplied to the system should be introduced via the entrance slot 42 into the vortex chamber 40. Preferably, at least more than 25 percent of the total air flow should be introduced into the vortex chamber 40 via the entrance slot 42.

Thus in order to assure clean combustion of the fuel and then of the particulates with a minimum of excess air, to assure minimum loss of heat via the wall of the burner housing 33 and, to effect maximum dispersion of heat uniformly to the entire inlet face of the filter 31, the following operational features, should be maintained:

1. A substantial part of the combustion air is introduced at the outside of a forced vortex within the vortex chamber that contains the reacting fuel;

2. Velocity of the air flow in the vortex chamber should be maintained below the onset of turbulence; and, 3. Within the vortex chamber, the angular velocity should be a substantial fraction of the total fluid stream velocity, preferably more than about 50 percent.

It is believed that the benefits of the subject invention result from causing the fuel combustion reaction to occur in a region of non-turbulent flow with increased residence time for the fuel within the reaction zone in the vortex chamber. The interior of the vortex chamber 40 within the cyclone duct 41, immediately downstream of the burner assembly 32, is fuel rich whereas the outer portion if oxygen rich due to the flow of incoming air via the air entrance slot 42. In this vortex flow pattern, fuel droplets will tend to move outward across streamlines due to centrifugal force, thus moving into a region undepleted of oxygen. The reaction products which ordinarily build up around the fuel droplet slowing completion of the reaction are thereby shed and the reaction continues to completion. Of course for this latter situation to prevail, a significant part of the combustion air, as noted above, must be delivered to the outer portion of the induced vortex via the air entrance slot 42.

With this arrangement, although the discharged flow from a conventional fuel burner assembly is normally in an axial direction, by positioning an air intake vortex chamber closely adjacent to the downstream end of the burner assembly in the manner shown, the resulting combined air and fuel pattern will have both axial and radial flow components, as desired, whereby not only is the combustion of fuel enhanced but the thus heated air will then flow so as to impinge substantially uniformly across the inlet face of the associate particulate filter located co-axial and downstream of the vortex chamber.

It should now be apparent to those skilled in the art, that one or more such air entrance slots, of the type described herein are an ideal way to achieve this result as well as to provide the vortex driving force within the vortex chamber.

Although in the configuration shown the fuel nozzle 35 is shown as located in a burner assembly upstream of the cyclone duct 41, it will be apparent to those skilled in the art that such a fuel nozzle or a non-atomizing type nozzle could be located, for example, at the left end, with reference to FIG. 1, of an within the cyclone duct 41; in which case, all combustion air would then be supplied through the air entrance slot 42.

In addition, although the embodiment of the exhaust cleaner system shown and described is in the form of a single path with exhaust bypass, it will be apparent to those skilled in the art that the system can be modified into a dual path system by replacing the bypass duct 24 with a second burner assembly 32, cyclone duct 40, auxiliary air duct 50 and exhaust cleaner member 20 assembly of the type previously described hereinabove.

The embodiments of the invention in which an exclusive property or privilege is claimed are defined as follows:

1. A diesel engine exhaust cleaner and burner system including at least one exhaust cleaner member means with a filter therein positioned between axial spaced apart inlet and outlet ends thereof; an inlet manifold means connected at one end to said inlet end of said cleaner member and at its other end having an inlet substantially co-axial with said inlet end and having a radial exhaust inlet; a valve controlled exhaust passage means operatively connected at one end to said exhaust inlet and at its other end being operatively connectable to the engine to receive exhaust discharged therefrom; a fuel burner means; a cyclone duct defining a vortex chamber operatively positioned between said fuel burner means and said inlet and co-axial therewith, said cyclone duct having a longitudinal air entrance slot extending through the outer peripheral portion thereof with the longitudinal extending sides of said air entrance slot defining a convolute shaped passage arranged so as to direct fluid flow in a direction substantially tangential to the inner peripheral wall surface of said cylcone duct; and, an air duct connectable at one end to a source of pressurized air, said air duct terminating at its opposite end in a duct portion having a longitudinal extending discharge slot therethrough that is operatively connected in flow communication with said air entrance slot for the introduction of air into said vortex chamber.

2. A diesel engine exhaust cleaner and burner system including at least one exhaust cleaner member having axial spaced apart inlet and outlet ends; a filter means positioned in said cleaner member intermediate said inlet and outlet ends; an inlet manifold connected at one end to said inlet end of said cleaner member and at its other end having an inlet substantially co-axial with said inlet end and having a radial exhaust inlet; a valve controlled exhaust passage means operatively connected at one end to said exhaust inlet and at its other end being operatively connectable to the engine to receive exhaust discharged therefrom; a fuel burner means; a cyclone duct defining a vortex chamber operatively positioned between said fuel burner means and said inlet and co-axial therewith, said cyclone duct having a longitudinal air entrance slot through the outer peripheral portion thereof with the longitudinal sides of said air entrance slot defining a convolute shaped passage arranged so as to direct fluid flow substantially tangential to the inner peripheral wall surface of said cyclone duct; and, an air duct connectable at one end to a source of pressurized air, said air duct terminating at its opposite end in a duct portion having a longitudinal extending discharge slot therethrough that is operatively connected to said cyclone duct for flow communication with said air entrance slot such so as to introduce air flow into said cyclone duct with an angular flow component.

3. A diesel engine exhaust cleaner and burner system including at least one exhaust cleaner member having axial spaced apart inlet and outlet ends; a filter means positiond in said cleaner member between said inlet and outlet ends; an inlet manifold connected at one end to said inlet end of said cleaner member and at its other end having an inlet substantially co-axial with said inlet end and having a radial exhaust inlet that is operatively connectable to the engine to receive exhaust discharged therefrom; a fuel burner means including a fuel nozzle adapted to receive fuel for combustion; a cyclone duct having a vortex chamber therein positioned for fluid flow between said fuel burner means and said inlet and co-axial therewith; said cyclone duct having an air entrance slot therethrough defining a convolute shaped passage arranged so as to direct air flow substantially tangential to the inner peripheral wall surface of said cyclone duct; and, an air passage means connectable at one end to a source of pressurized air and connected at its opposite end in flow communication with said air entrance slot, the arrangement being such so as to introduce air flow into said cyclone duct with an angular flow component to increase the residence time of fuel discharged from said fuel nozzle in the reaction region within said vortex chamber and to effect substantial uniform flow of the heat thus generated across the upstream end of said filter means.

* * * * *